US009995166B2

(12) United States Patent
Vandeputte

(10) Patent No.: US 9,995,166 B2
(45) Date of Patent: Jun. 12, 2018

(54) TURBOMACHINE INCLUDING A VANE AND METHOD OF ASSEMBLING SUCH TURBOMACHINE

(71) Applicant: General Electric Company, Schenectady, NY (US)

(72) Inventor: Thomas William Vandeputte, Scotia, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 424 days.

(21) Appl. No.: 14/550,506

(22) Filed: Nov. 21, 2014

(65) Prior Publication Data

US 2016/0146038 A1 May 26, 2016

(51) Int. Cl.

| | |
|---|---|
| ***F01D 9/04*** | (2006.01) |
| ***F01D 17/16*** | (2006.01) |
| ***F01D 5/14*** | (2006.01) |

(52) U.S. Cl.

CPC ..... *F01D 17/162* (2013.01); *F01D 5/145* (2013.01); *F01D 9/045* (2013.01); *F05D 2240/125* (2013.01)

(58) Field of Classification Search

CPC ..... F01D 17/162; F01D 5/145; F01D 9/045; F01D 9/04; F01D 9/041; F05D 2240/125

USPC ..... 415/160

See application file for complete search history.

(56) References Cited

U.S. PATENT DOCUMENTS

| | | | | |
|---|---|---|---|---|
| 2,314,572 A * | 3/1943 | Chitz | F01D 5/142 | 244/198 |
| 3,269,701 A * | 8/1966 | Miller | F01D 9/042 | 415/209.4 |
| 3,295,827 A * | 1/1967 | Chapman | F01D 5/148 | 415/156 |

(Continued)

FOREIGN PATENT DOCUMENTS

| | | |
|---|---|---|
| CA | 1115639 A1 | 1/1982 |
| CN | 101598037 B | 8/2011 |

(Continued)

OTHER PUBLICATIONS

PCT Search Report and Written Opinion issued in connection with corresponding PCT Application No. PCT/US2015/55848 dated Feb. 8, 2016.

(Continued)

*Primary Examiner* — Woody Lee, Jr.
*Assistant Examiner* — Brian Delrue
(74) *Attorney, Agent, or Firm* — GE Global Patent Operation; Pabitra K. Chakrabarti

(57) ABSTRACT

A vane for a turbomachine includes a pressure surface and a suction surface opposite the pressure surface. The pressure surface and the suction surface define a width therebetween. The vane also includes a first end. The first end includes a distal portion, a proximal portion, a pressure surface first portion, and a suction surface first portion. At least one of the pressure surface first portion and the suction surface first portion slope away from the other of the pressure surface first portion and the suction surface first portion such that the width increases from a first end minimum width at the proximal portion to a first end maximum width at the distal portion.

23 Claims, 4 Drawing Sheets

(56) References Cited

U.S. PATENT DOCUMENTS 3,314,654 A * 4/1967 Thenault ..... F01D 17/162 415/160
3,966,352 A 6/1976 White et al.
3,990,810 A * 11/1976 Amos ..... F01D 17/162 415/161
4,025,227 A 5/1977 Greenberg et al.
4,193,738 A 3/1980 Haap et al.
4,307,994 A * 12/1981 Brewer ..... F01D 17/162 415/160
4,514,141 A * 4/1985 Marey ..... F01D 17/162 415/160
4,652,208 A * 3/1987 Tameo ..... F01D 5/146 415/148
4,705,452 A * 11/1987 Karadimas ..... F01D 17/162 415/115
4,874,289 A * 10/1989 Smith, Jr. ..... F01D 17/162 415/150
5,039,277 A * 8/1991 Naudet ..... F04D 29/563 415/150
5,261,227 A * 11/1993 Giffin ..... F01D 17/162 60/226.1
5,362,202 A * 11/1994 Derouet ..... F01D 11/22 415/148
5,672,047 A * 9/1997 Birkholz ..... F01D 17/162 415/160
6,283,705 B1 9/2001 Rice et al.
7,628,579 B2 * 12/2009 Giaimo ..... F01D 17/162 415/160
7,670,107 B2 * 3/2010 Barthelet ..... F01D 17/165 29/889.2
8,011,882 B2 * 9/2011 McMillan ..... F01D 5/147 415/148
8,105,019 B2 1/2012 McCaffrey et al.
8,613,596 B2 12/2013 Fritsch
8,777,564 B2 7/2014 Zeng et al.
9,011,081 B2 4/2015 Gomez et al.
2002/0061249 A1 * 5/2002 Caubet ..... F01D 5/143 415/160
2005/0141990 A1 * 6/2005 Guemmer ..... F01D 5/145 415/134
2005/0249593 A1 * 11/2005 Boury ..... B22C 9/103 416/97 R
2006/0078420 A1 * 4/2006 Barbe ..... F01D 17/162 415/159
2006/0216140 A1 * 9/2006 Dervaux ..... F01D 5/08 415/115
2006/0228211 A1 * 10/2006 Vance ..... F01D 5/14 415/200
2007/0140837 A1 * 6/2007 Guemmer ..... F01D 5/141 415/160
2007/0160463 A1 * 7/2007 Jahns ..... F01D 17/162 415/160
2008/0152505 A1 * 6/2008 Burton ..... F01D 5/141 416/223 R
2010/0266389 A1 * 10/2010 Cloarec ..... F01D 17/162 415/148
2012/0210715 A1 * 8/2012 Shibata ..... F01D 5/141 60/670
2012/0230818 A1 * 9/2012 Shepherd ..... F01D 5/20 415/208.1
2014/0119920 A1 5/2014 Coull et al.
2014/0147265 A1 * 5/2014 Biemar ..... F01D 17/162 415/209.2
2014/0248154 A1 * 9/2014 Guemmer ..... F01D 5/141 416/223 A
2015/0176418 A1 * 6/2015 Marshall ..... F04D 29/544 415/1
2015/0218955 A1 * 8/2015 Bintz ..... F01D 5/20 416/1
2015/0275916 A1 * 10/2015 Marshall ..... F01D 17/162 415/148
2016/0290158 A1 * 10/2016 Slavens ..... F02C 3/04

FOREIGN PATENT DOCUMENTS

DE 10323132 A1 12/2004
DE 102009036406 A1 2/2011
EP 0965727 A2 12/1999
EP 1225303 A2 * 7/2002 ..... F01D 5/141
EP 1918521 A2 5/2008
GB 1049080 A * 11/1966 ..... F01D 17/162
GB 1112058 A * 5/1968 ..... F01D 5/148
JP 2013133742 A 7/2013

OTHER PUBLICATIONS

Bagshaw et al., An experimental study of reverse compound lean in a linear turbine cascade, Journal of Power and Energy, Sep. 1, 2005, vol. 219, No. 6, pp. 443-449.
Harrison, The Influence of Blade Lean on Turbine Losses, Journal of Turbomachinery, Jan. 1, 1992, vol. 114, Issue 1, pp. 184-190.
Bagshaw et al., An experimental study of three-dimensional turbine blades combined with profiled endwalls, Journal of Power and Energy, Feb. 1, 2008, vol. 222, No. 1, pp. 103-110.

* cited by examiner

TURBOMACHINE INCLUDING A VANE AND METHOD OF ASSEMBLING SUCH TURBOMACHINE

BACKGROUND

The field of the disclosure relates generally to turbomachines, and more particularly, to turbomachines that include a variable geometry vane in a first stage of a power turbine and to methods of assembling turbomachines including a variable geometry vane.

At least some known turbomachines are turbine engines that include a combustor, a compressor coupled upstream from the combustor, a turbine, and a rotor assembly rotatably coupled between the compressor and the turbine. Some known rotor assemblies include a rotor shaft, and a plurality of turbine blade assemblies coupled to the rotor shaft such that a gas flow path is defined between a turbine inlet and a turbine outlet. Each turbine blade assembly includes a plurality of circumferentially-spaced turbine blades that extend outwardly from a rotor disk.

At least some known turbine engines include a plurality of stationary vane assemblies that are oriented between adjacent turbine blade assemblies. Each vane assembly includes a plurality of circumferentially-spaced vanes that extend outwardly from a turbine casing towards a rotor assembly. Each vane is oriented to channel the combustion gases towards adjacent turbine blades to rotate turbine blades. As the combustion gases impact the vanes, at least a portion of the combustion gas flow energy is imparted on the vanes. This flow energy loss reduces the combustion gas flow energy available to rotate the rotor assembly and produce useful work and, thus, reduces an operating efficiency of the turbine.

Some known stationary vane assemblies are variable geometry vane assemblies that facilitate adjusting the cross-sectional area of combustion gases flowing towards the rotor assembly. Each variable geometry vane assembly includes a plurality of circumferentially-spaced variable geometry vanes that are adjustable. One type of variable geometry vane pivots about a pivot axis extending through the variable geometry vane. To facilitate pivoting, the variable geometry vanes are pivotably coupled to the turbine casing and rotor assembly with a clearance space at each end of the variable geometry vanes. As the combustion gases impact the variable geometry vanes, at least a portion of the combustion gases flow over the ends of the variable geometry vanes and through this clearance space. The flow over the ends increases the amount of the combustion gas flow energy that is imparted on the vanes. Additionally, the flow through the clearance space generates tip vortexes and mixing loss. The tip vortexes and mixing loss reduce the operating efficiency of the turbine.

BRIEF DESCRIPTION

In one aspect, a vane for a turbomachine is provided. The vane includes a pressure surface and a suction surface opposite the pressure surface. The pressure surface and the suction surface define a width therebetween. The vane also includes a first end. The first end includes a distal portion, a proximal portion, a pressure surface first portion, and a suction surface first portion. At least one of the pressure surface first portion and the suction surface first portion slope away from the other of the pressure surface first portion and the suction surface first portion such that the width increases from a first end minimum width at the proximal portion to a first end maximum width at the distal portion.

In another aspect, a turbomachine is provided. The turbomachine includes at least one rotatable element and a casing extending at least partly circumferentially around the at least one rotatable element. The casing at least partially defines an airway. The turbomachine also includes a vane extending across the airway. The vane includes a pressure surface and a suction surface opposite the pressure surface. The pressure surface and the suction surface define a width therebetween. The vane also includes a first end including a distal portion, a proximal portion, a pressure surface first portion, and a suction surface first portion. The distal portion is coupled to the casing such that the distal portion is spaced from the casing. At least one of the pressure surface first portion and the suction surface first portion slopes away from the other of the pressure surface first portion and the suction surface first portion such that the width increases from a first end minimum width at the proximal portion to a first end maximum width at the distal portion.

In a further aspect, a method of assembling a turbomachine is provided. The method includes coupling a first casing member to a second casing member to at least partially enclose a rotatable element. The first casing member and second casing member at least partially define an airway. The method also includes forming a flared vane. The flared vane includes a pressure surface and a suction surface opposite the pressure surface. The pressure surface and the suction surface define a width therebetween. The flared vane also includes a first end including a proximal portion, a pressure surface first portion, a distal portion having a first distal surface, and a suction surface first portion. At least one of the pressure surface first portion and the suction surface first portion slopes away from the other of the pressure surface first portion and the suction surface first portion such that the width increases from a first end minimum width at the proximal portion to a first end maximum width at the distal portion. The method further includes pivotably coupling the first end to the first casing member such that the first distal surface is spaced from the first casing member and the vane pivots about a pivot axis through the vane.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The exemplary methods and systems described herein overcome at least some disadvantages of known turbomachines by providing a variable geometry vane that reduces the flow of combustion gases through a clearance space between a first end of the variable geometry vane and a turbomachine casing. More specifically, the embodiments described herein provide a turbomachine that includes at least one variable geometry vane having a pressure surface and a suction surface defining a width therebetween. The width increases to a maximum width at the first end. Due to the first end maximum width, the variable geometry vane decreases the amount of combustion gases that flow over the first end and through the clearance space between the first end and the turbomachine casing. Additionally, the first end maximum width redirects flow towards the center of the combustion gas path to increase work extraction in the turbomachine.

As used herein, the term "upstream" refers to a forward or inlet end of a gas turbine engine, and the term "downstream" refers to an aft or nozzle end of the gas turbine engine.

Figure 1:
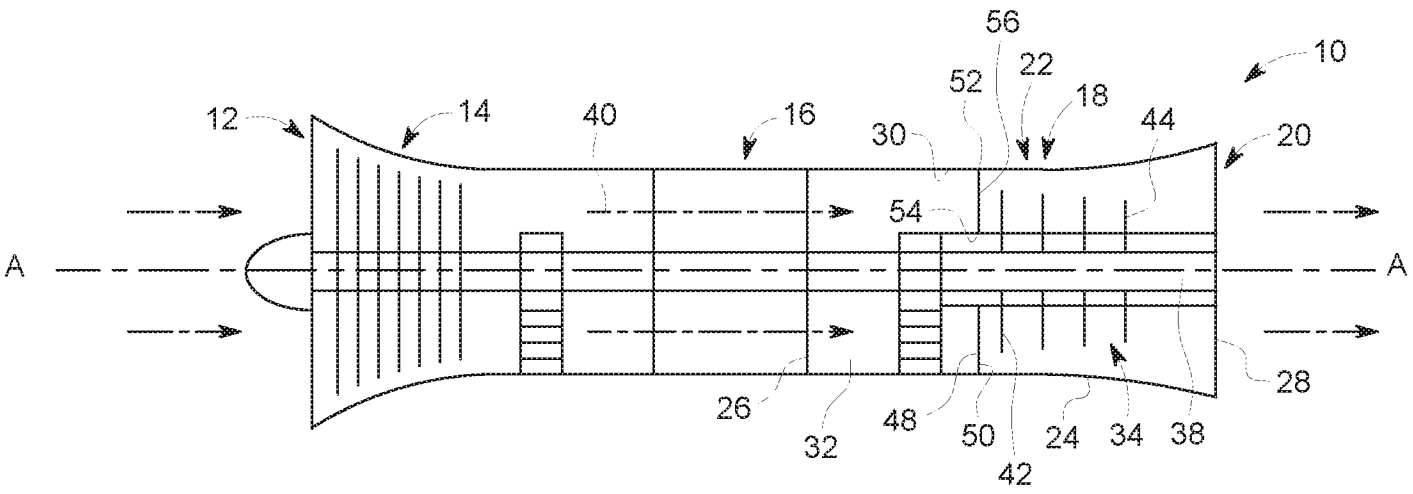
FIG. 1 is a cross-sectional view of an exemplary turbomachine.

FIG. 1 is a cross-sectional view of an exemplary turbomachine. In the exemplary embodiment, the turbomachine is a gas turbine engine 10. Alternatively, the turbomachine is any other turbine engine and/or rotary machine, including, without limitation, a steam turbine engine, a centrifugal compressor, and a turbocharger. In the exemplary embodiment, turbine engine 10 includes an intake section 12, a compressor section 14 coupled downstream from intake section 12, combustor system 16 coupled downstream from compressor section 14, a turbine section 18 coupled downstream from compressor section 14, and an exhaust section 20. Turbine section 18 is rotatably coupled to compressor section 14 and to a load (not shown) such as, but not limited to, an electrical generator and a mechanical drive application.

In operation, first intake section 12 channels air towards compressor section 14. Compressor section 14 compresses the air to a higher pressure and temperature and discharges the compressed air to combustor system 16 and to turbine section 18. Combustor system 16 is coupled to compressor section 14 and receives at least a portion of compressed air from compressor section 14. In the exemplary embodiment, combustor system 16 mixes fuel with the compressed air and ignites it to generate combustion gases that flow to turbine section 18. Combustion gases are channeled to turbine section 18 wherein gas stream thermal energy is converted to mechanical rotational energy to enable turbine section 18 to drive compressor section 14 and/or a load (not shown). Ultimately, turbine section 18 channels exhaust gases to exhaust section 20 and discharges the exhaust gases to ambient atmosphere.

In the exemplary embodiment, turbine section 18 includes a turbine assembly 22 that includes a casing 24 extending between a fluid inlet 26 and a fluid outlet 28. Casing 24 includes an inner surface 30 that defines a cavity 32 extending between fluid inlet 26 and fluid outlet 28. Turbine assembly 22 further includes a rotor assembly 34 extending along a centerline axis A-A and coupled to compressor section 14 via a rotor shaft 38. In alternate embodiments, turbine engine 10 has a high pressure turbine assembly (not shown) coupled to compressor section 14 via a second shaft (not shown). In the exemplary embodiment, rotor assembly 34 is positioned within cavity 32 and oriented with respect to casing 24 such that a combustion gas path 40 is at least partially defined between rotor assembly 34 and casing 24. Combustion gas path 40 extends from fluid inlet 26 to fluid outlet 28.

Rotor assembly 34 includes a plurality of turbine blade assemblies 42 that are coupled to rotor shaft 38. Each turbine blade assembly 42 includes a plurality of turbine blades 44 that extend radially outwardly from rotor shaft 38 and rotate about centerline axis A-A. Each turbine blade 44 extends at least partially through a portion of combustion gas path 40. In operation, combustion gas path 40 contacts turbine blades 44 and, thereby, causes turbine blade assemblies 42 to rotate.

A variable geometry vane assembly 48 is coupled to casing inner surface 30 such that variable geometry vane assembly 48 circumscribes rotor shaft 38. Variable geometry vane assembly 48 is positioned to channel combustion gases towards turbine blade assemblies 42 such that combustion gases rotate turbine blade assemblies 42. Variable geometry vane assembly 48 facilitates adjusting the cross-sectional area of combustion gas path 40 to maintain an optimum aspect ratio of the turbine engine 10 as operating conditions change.

Figure 2:
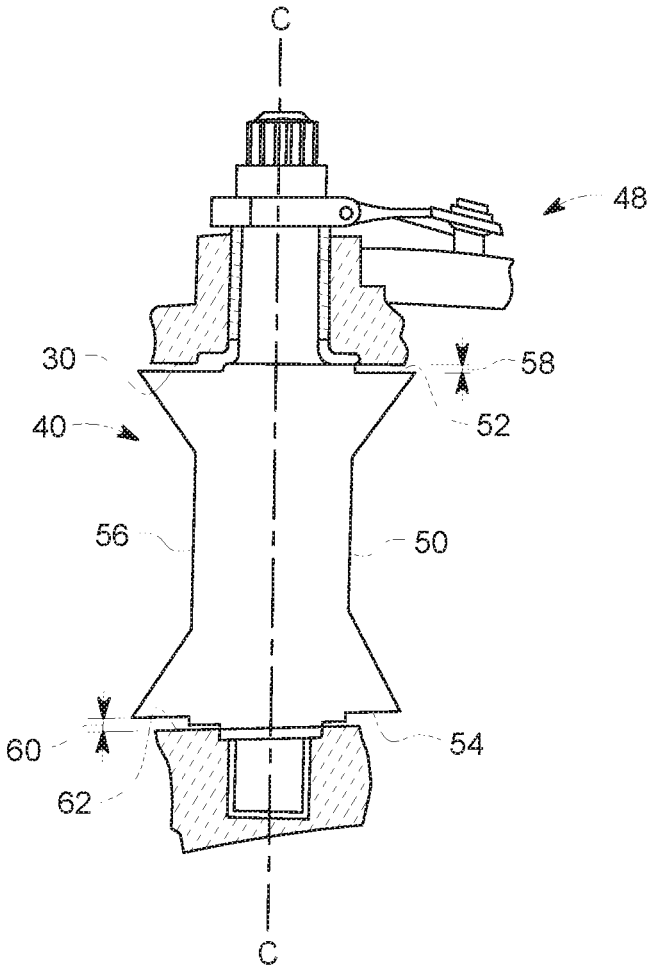
FIG. 2 is a cross-section view of a portion of an exemplary variable geometry vane assembly that may be used with the turbomachine shown in FIG. 1.

FIG. 2 is a cross-sectional view of a portion of variable geometry vane assembly 48. In the exemplary embodiment, variable geometry vane assembly 48 includes a plurality of vanes 50. In the exemplary embodiment, vanes 50 are variable geometry vanes 56 that are each positionable to adjust the cross-sectional area of combustion gas path 40. In alternative embodiments, not all of vanes 50 are positionable. In the exemplary embodiment, each variable geometry vane 56 pivots about a pivot axis C-C running through each variable geometry vane 56. Variable geometry vane 56 adjusts the effective cross-sectional area of combustion gas path 40 by pivoting. By pivoting, variable geometry vane 56 adjusts the angle variable geometry vane 56 has in relation to the direction of combustion gases. The adjusted angle alters the open area between the variable geometry vane 56 and another surface, i.e., the throat area, which in turn alters the operating point of the turbine engine 10. In alternative embodiments, variable geometry vanes 56 adjust the cross-sectional area of combustion gas path 40 in any manner suitable to function as described herein. In the exemplary embodiment, variable geometry vane 56 has clearance spaces 58, 60 at each end to facilitate pivoting. Suitably, each clearance space 58, 60 equals between about 0.6% and 1.3% of the vane height. In alternative embodiments, each clearance space 58, 60 has any measurement sufficient to allow variable geometry vane 56 to pivot.

Each variable geometry vane 56 includes a first distal surface 52 pivotably coupled to casing 24 (shown in FIG. 1) and a second distal surface 54 pivotably coupled to rotor assembly 34 (shown in FIG. 1). First distal surface 52 is contoured to match inner surface 30 such that clearance space 58 between first distal surface 52 and inner surface 30 (shown in FIG. 1) remains constant as variable geometry vane 56 is pivoted. Similarly, second distal surface 54 is contoured to match a surface 62 of rotor assembly 34 such that clearance space 60 between second distal surface and surface 62 remains constant as variable geometry vane 56 is pivoted. In alternative embodiments, first distal surface 52 and second distal surface 54 are contoured such that clearance spaces 58, 60 vary as variable geometry vanes 56 are pivoted.

Figure 3:
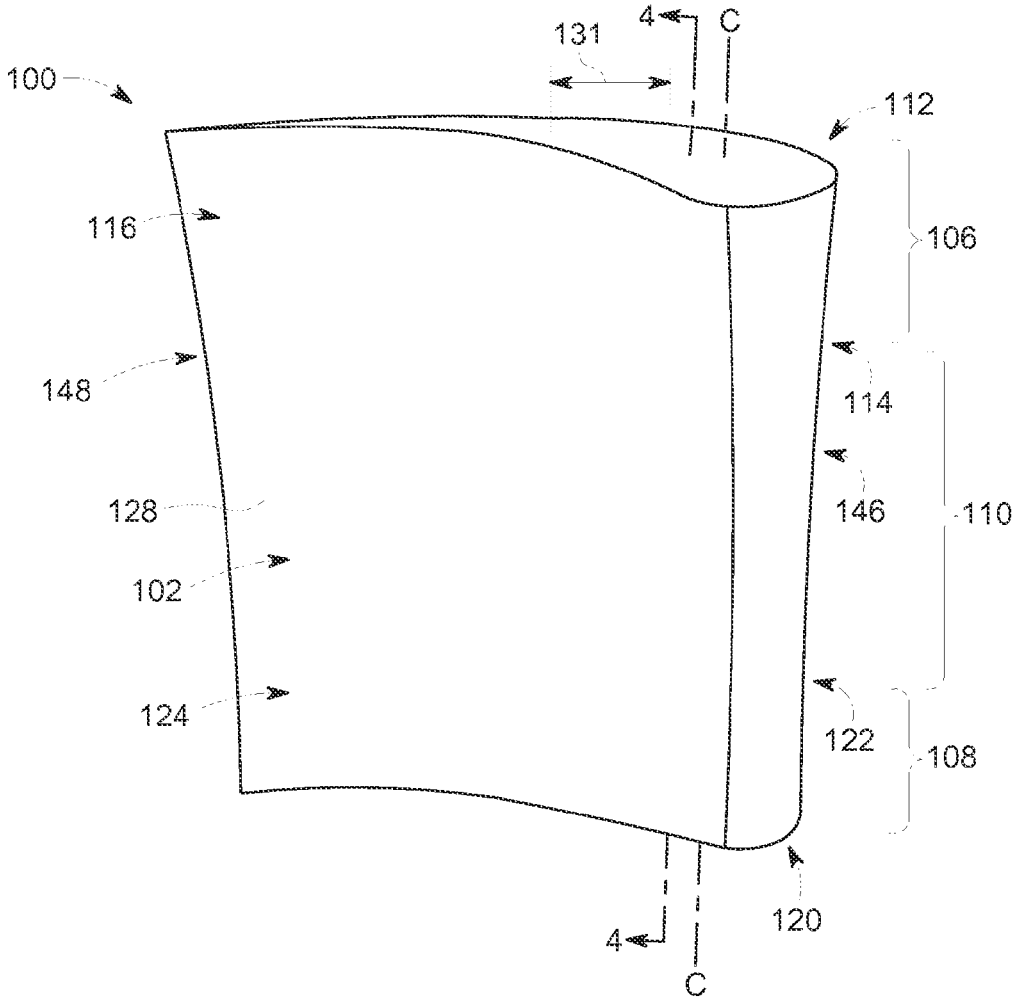
FIG. 3 is a perspective view of an alternative exemplary variable geometry vane.
Figure 4:
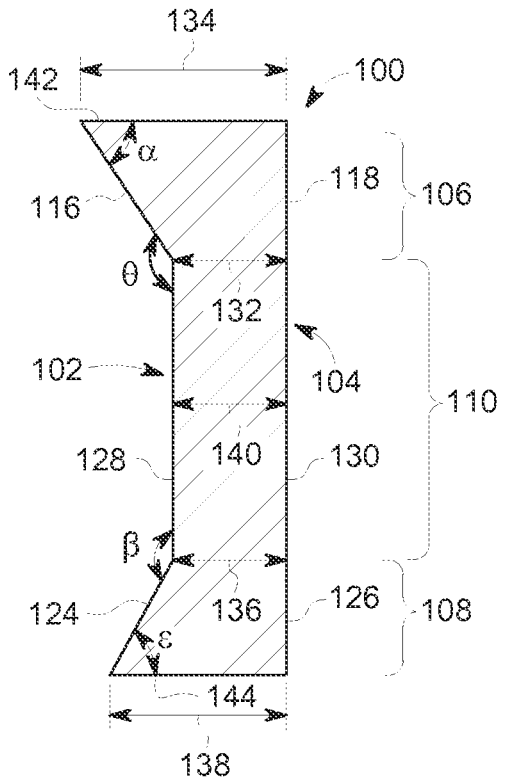
FIG. 4 is a cross-sectional view of the variable geometry vane shown in FIG. 3 taken along line 4-4.

FIG. 3 is a perspective view of an exemplary variable geometry vane 100. FIG. 4 is a cross-sectional view of variable geometry vane 100 taken along line 4-4. Variable geometry vane 100 is similar to variable geometry vane 56 shown in FIGS. 1-2, except, most notably, variable geometry vane 100 is flared on only one side. Variable geometry vane 100 includes a pressure surface 102, a suction surface 104 opposite pressure surface 102, a first end 106, a second end 108, and a middle portion 110 extending between first end 106 and second end 108. First end 106 includes a first end distal portion 112, a first end proximal portion 114, a pressure surface first portion 116, and a suction surface first portion 118. Second end 108 includes a second end distal portion 120, a second end proximal portion 122, a pressure surface second portion 124, and a suction surface second portion 126. Middle portion 110 includes a pressure surface middle portion 128 and a suction surface middle portion 130. Middle portion 110 is coupled to first end proximal portion 114 and second end proximal portion 122. In the exemplary embodiment first end 106, second end 108, and middle portion 110 are integrally formed. In alternative embodiments, first end 106, second end 108, and middle portion 110 are formed and coupled together in any manner that enables variable geometry vane 100 to function as described herein. In the exemplary embodiment, variable geometry vane 100 pivots about pivot axis C-C. As used herein, "axial direction" means in a direction parallel to pivot axis C-C.

Variable geometry vane 100 is suitably fabricated from any number of materials, including, but not limited to, plastic, metal, and flexible or compliant materials. For example, variable geometry vane 100 is formed by a molding, forming, extruding, and/or three-dimensional printing process used for fabricating parts from thermoplastic or thermosetting plastic materials and/or metals. Alternatively, variable geometry vane 100 is fabricated from a combination of materials such as attaching a flexible or compliant material to a rigid material. In alternative embodiments, variable geometry vane 100, however, is constructed of any suitable material, such as metal, that enables variable geometry vane 100 to operate as described herein.

In the exemplary embodiment, pressure surface 102 and suction surface 104 define a vane width 131 therebetween. Variable geometry vane 100 increases in width at first end 106 and second end 108, i.e., variable geometry vane 100 has a flared shape. The flared shape of variable geometry vane 100 reduces the amount of combustion gases that flow over first end 106 and second end 108 and through clearance spaces between a surface (not shown) and variable geometry vane 100 when variable geometry vane 100 is included in turbine assembly 22 (shown in FIG. 1). In alternative embodiments, variable geometry vane 100 is flared at one end only.

In the exemplary embodiment, pressure surface first portion 116 slopes away from suction surface first portion 118 in the axial direction such that the vane width increases from a first end minimum width 132 at first end proximal portion 114 to a first end maximum width 134 at first end distal portion 112. As used herein, "slope" means that a surface is angled in relation to another surface, i.e., the surfaces are not parallel in the axial direction. For example, in the exemplary embodiment, pressure surface first portion 116 is angled in relation to suction surface first portion 118. Suction surface first portion 118 is substantially coplanar with suction surface middle portion 130. In alternative embodiments, both pressure surface first portion 116 and suction surface first portion 118 slope away from each other such that the vane width increases. Alternatively, suction surface first portion 118 slopes away from pressure surface first portion 116 and pressure surface first portion 116 is substantially coplanar with pressure surface middle portion 128.

In the exemplary embodiment, pressure surface middle portion 128 and suction surface middle portion are substantially parallel in the axial direction. Since suction surface first portion 118 is coplanar with suction surface middle portion 130, suction surface first portion 118 is also substantially parallel with pressure surface middle portion 128 in the axial direction. In contrast, pressure surface first portion 116 forms an angle $\theta$ with pressure surface middle portion 128. In one suitable embodiment, angle $\theta$ is in the range between about 140° and about 165°. In the exemplary embodiment, angle $\theta$ is about 155°. In alternative embodiments, pressure surface first portion 116 forms any angle $\theta$ with pressure surface middle portion 128 that enables operation of variable geometry vane 100 as described herein.

In the exemplary embodiment, in the axial direction, pressure surface second portion 124 slopes away from suction surface second portion 126 such that the vane width increases from a second end minimum width 136 at second end proximal portion 122 to a second end maximum width 138 at second end distal portion 120. Suction surface second portion 126 is coplanar with suction surface middle portion 130. In alternative embodiments, both pressure surface second portion 124 and suction surface second portion 126 slope away from each other such that the vane width increases. Alternatively, suction surface second portion 126 slopes away from pressure surface second portion 124 and pressure surface second portion 124 is coplanar with pressure surface middle portion 128.

In the exemplary embodiment, pressure surface second portion 124 forms an angle $\beta$ with pressure surface middle portion 128. In one suitable embodiment, angle $\beta$ is in the range between about 140° and about 165°. In the exemplary embodiment, angle $\beta$ is about 155°. In alternative embodiments, pressure surface second portion 124 forms any angle $\beta$ with pressure surface middle portion 128.

In the exemplary embodiment, first end minimum width 132, is approximately equal to second end minimum width 136 and first end maximum width 134 is greater than second end maximum width 138. In alternative embodiments, first end minimum width 132 does not equal second end minimum width 136 and/or first end maximum width 134 is less than or equal to second end maximum width 138. In the exemplary embodiment, pressure surface middle portion 128 and suction surface middle portion 130 define a middle portion width 140 that is substantially constant throughout middle portion 110. In alternative embodiments, middle portion width 140 varies. In the exemplary embodiment, middle portion width 140 is approximately equal to each of first end minimum width 132 and second end minimum width 136.

First end distal portion 112 includes a first distal surface 142 extending between pressure surface first portion 116 and pressure surface second portion 124. First distal surface 142 forms an angle $\alpha$ with pressure surface first portion 116 and a 90° angle with suction surface first portion 118. First distal surface 142 is substantially perpendicular to pressure surface middle portion 128 and the slope of pressure surface portion 116 remains substantially constant from first end proximal portion 114 to first end distal portion 112. Therefore, the measure of angle $\alpha$ approximately equals the measure of angle $\theta$ minus 90° in the exemplary embodiment. In one suitable embodiment, angle $\alpha$ is in the range between about 50° and about 75°. In the exemplary embodiment, angle $\alpha$ is about 65°. In alternative embodiments, first distal surface 142 forms any angle with pressure surface first portion 116 and suction surface first portion 118.

In the exemplary embodiment, second end distal portion 120 includes a second distal surface 144 extending between pressure surface second portion 124 and suction surface second portion 126 opposite first end distal surface 142. Second end distal portion 120 forms a 90° angle with suction surface second portion 126. Additionally, second end distal portion 120 forms an angle $\epsilon$ with pressure surface second portion 124.

In the exemplary embodiment, angles $\theta$, $\beta$, $\alpha$, and $\epsilon$ vary along variable geometry vane 100. Specifically, angles $\theta$, $\beta$, $\alpha$, and $\epsilon$ increase from minimum angles measured at a leading edge 146 to maximum angles measured at a trailing edge 148. Therefore, the flares of variable geometry vane 100 decrease from leading edge 146 to trailing edge 148. In alternate embodiments, the flares of variable geometry vane 100 remain constant and/or vary in any manner suitable to function as described herein. In the exemplary embodiment, angles $\theta$ and $\beta$ increase to approximately 180° such that pressure surface first portion 116, pressure surface middle portion 128, and pressure surface second portion 124 are substantially coplanar at trailing edge 148.

In a direction transverse to pivot axis C-C, pressure surface 102 and suction surface 104 slope towards each other such that pressure surface 102 and suction surface 104 meet at trailing edge 148. Thus, pressure surface 102 and suction surface 104 are curved to form an airfoil that facilitates airflow over variable geometry vane 100. The decrease in flare from leading edge 146 to trailing edge 148 is proportional to the decreasing width between pressure surface 102 and suction surface 104; therefore, the decreased flare close to trailing edge 148 has substantially the same effect as the flare at leading edge 146. In alternate embodiments, pressure surface 102 and suction surface 104 do not slope towards each other.

In reference to FIGS. 1, 2, and 4, an exemplary method of assembling turbine engine 10 includes coupling casing 24 to rotor assembly 34 such that combustion gas path 40 is defined between rotor assembly 34 and casing 24. Combustion gas path 40 extends between fluid inlet 26 and fluid outlet 28. The exemplary method further includes forming variable geometry vane 100 having pressure surface 102, suction surface 104 opposite pressure surface 102, and first end 106. Variable geometry vane 100 increases in width at first end 106 such that variable geometry vane 100 has a flared shape.

First end 106 is pivotably coupled to casing 24 such that first distal surface 142 is spaced from casing 24. Additionally, variable geometry vane 100 is pivotably coupled to rotor assembly 34 such that second distal surface 144 is spaced from rotor assembly 34. First distal surface 142 is aligned with casing 24 such that clearance space 58 between first distal surface 142 and casing 24 remains constant during pivoting movement of variable geometry vane 100. The exemplary method further includes coupling a plurality of variable geometry vanes 100 to casing 24 to form variable geometry vane assembly 48.

The above-described combustor system overcomes at least some disadvantages of known turbine engines by providing a turbomachine with a variable geometry vane that reduces the flow of combustion gases through a clearance space between the vane and a turbomachine casing. Therefore, the flow losses that are generated within the combustion gas path are reduced, thus reducing the losses in gas energy and increasing the efficiency of the turbine engine. The increased efficiency will minimize the fuel burned and reduce the operating costs of the turbine engine.

An exemplary technical effect of the methods, systems, and apparatus described herein includes at least one of: (a) reducing the flow of combustion gases through a clearance space between a first end of the variable geometry vane and a turbomachine casing; (b) redirecting flow towards the center of the combustion gas path to increase work extraction in the turbomachine; (c) decreasing the amount of the combustion gas flow energy that is imparted on the variable geometry vanes; and (d) reducing the generation of tip vortexes and mixing loss.

Exemplary embodiments of a turbomachine including a variable geometry vane and methods of operating a turbomachine are described above in detail. The methods and apparatus are not limited to the specific embodiments described herein, but rather, components of systems and/or steps of the method may be utilized independently and separately from other components and/or steps described herein. For example, the methods and apparatus may also be used in combination with other combustion systems and methods, and are not limited to practice with only the turbine engine as described herein. Rather, the exemplary embodiment can be implemented and utilized in connection with many other combustion system applications.

Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A vane for a turbomachine, said vane comprising:
a pressure surface;
a suction surface opposite said pressure surface, said pressure surface and said suction surface defining a width therebetween;
a first end comprising:
a distal portion including a distal surface extending from said pressure surface to said suction surface;
a proximal portion;
a pressure surface first portion; and
a suction surface first portion, at least one of said pressure surface first portion and said suction surface first portion sloping away from the other of said pressure surface first portion and said suction surface first portion such that said width increases from a first end minimum width at said proximal portion to a first end maximum width at said distal portion, wherein said at least one of said pressure surface first portion and said suction surface first portion is sloped along an extension from said proximal portion to said distal portion distal surface;
wherein the slope of said at least one of said pressure surface first portion and said suction surface first portion is constant from said proximal portion to said distal surface.

2. The vane in accordance with claim 1, wherein said second end distal portion includes a second distal surface extending from said pressure surface to said suction surface,
at least one of said pressure surface second portion and said suction surface second portion sloping away from the other of said pressure surface second portion and said suction surface second portion such that said width increases from a second end minimum width at said second end proximal portion to a second end maximum width at said second end distal portion, wherein said at least one of said pressure surface second portion and said suction surface second portion is sloped along an extension from said second end proximal portion to said second distal surface.

3. The vane in accordance with claim 2, wherein said pressure surface and said suction surface define a middle portion width that is substantially constant throughout said middle portion, said middle portion width equal to said first end minimum width and said second end minimum width.

4. The vane in accordance with claim 3, wherein said first end maximum width equals said second end maximum width.

5. The vane in accordance with claim 2, wherein said first end maximum width is greater than said second end maximum width.

6. The vane in accordance with claim 1, wherein said pressure surface first portion makes an angle between about 140° and about 165° with said pressure surface middle portion.

7. The vane in accordance with claim 1, wherein both said pressure surface first portion and said suction surface first portion are sloped.

8. The vane in accordance with claim 2, wherein both said first end distal portion and said second end distal portion are pivotably coupled to the turbomachine.

9. The vane in accordance with claim 8, wherein said distal surface is contoured to match an inner surface of the turbomachine such that a clearance space between said distal surface and said inner surface remains constant as said vane is pivoted.

10. The vane in accordance with claim 9, wherein said second end distal portion comprises a second distal surface, said second distal surface contoured to match a second inner surface of the turbomachine such that a clearance space between said second distal surface and said second inner surface remains constant as said vane is pivoted.

11. A turbomachine comprising:
at least one rotatable element;
a casing extending at least partly circumferentially around said at least one rotatable element, said casing at least partially defining an airway; and
a vane extending across said airway, said vane comprising:
a pressure surface;
a suction surface opposite said pressure surface, said pressure surface and said suction surface defining a width therebetween; and
a first end comprising:
a distal portion coupled to said casing said distal portion including a distal surface extending from said pressure surface to said suction surface, wherein said distal surface and said casing define a clearance space therebetween;
a proximal portion;
a pressure surface first portion; and
a suction surface first portion, at least one of said pressure surface first portion and said suction surface first portion sloping away from the other of said pressure surface first portion and said suction surface first portion such that said width increases from a first end minimum width at said proximal portion to a first end maximum width at said distal portion, wherein said at least one of said pressure surface first portion and said suction surface first portion is sloped along an extension from said proximal portion to said distal surface;
wherein the slope of said at least one of said pressure surface first portion and said suction surface first portion is constant from said proximal portion to said distal surface.

12. The turbomachine in accordance with claim 11, wherein said vane further comprises a second end comprising:
a distal portion coupled to said casing, said second end distal portion including a second distal surface extending from said pressure surface to said suction surface, wherein said second distal surface and said casing define a second clearance space therebetween; and
a proximal portion.

13. The turbomachine in accordance with claim 12, wherein said vane further comprises a middle portion extending between said first end and said second end, said middle portion coupled to said first end proximal portion and to said second end proximal portion.

14. The turbomachine in accordance with claim 12, wherein said second end further comprises:
a pressure surface second portion; and
a suction surface second portion, at least one of said pressure surface second portion and said suction surface second portion sloping away from the other of said pressure surface second portion and said suction surface second portion such that said width increases from a second end minimum width at said second end proximal portion to a second end maximum width at said second end distal portion, wherein said at least one of said pressure surface second portion and said suction surface second portion is sloped along an extension from said second end proximal portion to said second distal surface.

15. The turbomachine in accordance with claim 13 wherein said vane pivots about a pivot axis extending through said vane from said first end to said second end.

16. The turbomachine in accordance with claim 11, wherein said vane has a height and said first end distal portion is spaced from said casing a distance between about 0.6% and about 1.3% of said height.

17. The turbomachine in accordance with claim 12, wherein said vane has a height and said second end distal portion is spaced from said casing a distance between about 0.6% and about 1.3% of said height.

18. A method of assembling a turbomachine, said method comprising:

coupling a first casing member to a second casing member to at least partially enclose a rotatable element, the first casing member and second casing member at least partially defining an airway;

forming a flared vane including:

a pressure surface;

a suction surface opposite the pressure surface, the pressure surface and the suction surface defining a width therebetween; and a first end including:

a distal portion having a first distal surface extending from the pressure surface to the suction surface;

a proximal portion;

a pressure surface first portion; and a suction surface first portion, at least one of the pressure surface first portion and the suction surface first portion sloping away from the other of the pressure surface first portion and the suction surface first portion such that the width increases from a first end minimum width at the proximal portion to a first end maximum width at the distal portion, wherein the at least one of the pressure surface first portion and the suction surface first portion is sloped along an extension from the proximal portion to the first distal surface;

wherein the slope of said at least one of said pressure surface first portion and said suction surface first portion is constant from said proximal portion to said distal surface; and pivotably coupling the first end to the first casing member such that the first distal surface is spaced from the first casing member and the vane pivots about a pivot axis through the vane.

19. The method in accordance with claim 18, wherein forming the flared vane comprises forming the flared vane including:

a second end comprising:

a distal portion having a second distal surface extending from the pressure surface to the suction surface;

a proximal portion;

a pressure surface second portion; and a suction surface second portion, at least one of the pressure surface second portion and the suction surface second portion sloping away from the other of the pressure surface second portion and the suction surface second portion such that the width increases from a second end minimum width at the second end proximal portion to a second end maximum width at the second end distal portion, wherein the at least one of the pressure surface second portion and the suction surface second portion is sloped along an extension from the second end proximal portion to the second distal surface.

20. The method in accordance with claim 19 further comprising pivotably coupling the vane to the second casing member such that the second distal surface is spaced from the second casing member and such that the vane pivots about the pivot axis.

21. The method in accordance with claim 18 further comprising aligning the first distal surface with the first casing member such that the clearance space between the first distal surface and the first casing member is constant during pivoting movement of the vane.

22. The method in accordance with claim 18 further comprising coupling a plurality of flared vanes to the first casing member.

23. The method in accordance with claim 18 further comprising aligning the first end with the first casing member such that the sloped portion of at least one of the pressure surface first portion and the suction surface first portion makes between about 50° and about 75° with the first casing member.

* * * * *